US011365888B2

(12) United States Patent
Cadima

(10) Patent No.: US 11,365,888 B2
(45) Date of Patent: Jun. 21, 2022

(54) COOKTOP APPLIANCE WITH MODULAR GRIDDLE SYSTEM

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 21 days.

(21) Appl. No.: 16/703,943

(22) Filed: Dec. 5, 2019

(65) Prior Publication Data

US 2021/0172607 A1 Jun. 10, 2021

(51) Int. Cl.

| | |
|---|---|
| ***F24C 3/12*** | (2006.01) |
| ***F24C 15/10*** | (2006.01) |
| ***F24C 3/08*** | (2006.01) |
| ***F24C 15/08*** | (2006.01) |

(52) U.S. Cl.

CPC ..... *F24C 3/12* (2013.01); *F24C 3/082* (2013.01); *F24C 15/08* (2013.01); *F24C 15/107* (2013.01); *F24C 15/108* (2013.01)

(58) Field of Classification Search

CPC ..... F24C 3/126; F24C 15/107; F24C 15/108; F24C 15/08; F24C 3/082; F24C 3/12; F24C 15/28; A47J 37/067; A47J 37/0786

See application file for complete search history.

(56) References Cited

U.S. PATENT DOCUMENTS

| | | | | |
|---|---|---|---|---|
| 3,100,995 | A | 8/1963 | Woodward | |
| 5,413,032 | A * | 5/1995 | Bruno | A47J 37/0676 219/436 |
| 5,740,723 | A * | 4/1998 | Lin | A47J 37/0682 126/39 K |
| 6,138,554 | A | 10/2000 | McFadden et al. | |
| 2009/0235918 | A1 * | 9/2009 | Espina | F23Q 9/045 126/39 G |
| 2018/0142897 | A1 | 5/2018 | Cadima | |
| 2018/0340691 | A1 | 11/2018 | Cadima | |

FOREIGN PATENT DOCUMENTS

| | | | |
|---|---|---|---|
| CN | 207936129 | U | 10/2018 |
| EP | 1764559 | B1 | 3/2013 |
| JP | 2011075261 | A | 4/2011 |
| KR | 101802776 | B1 | 12/2017 |

* cited by examiner

*Primary Examiner* — Alfred Basichas
(74) *Attorney, Agent, or Firm* — Dority & Manning, P.A.

(57) ABSTRACT

A cooktop appliance includes a panel with a first burner disposed on the panel and a second burner spaced apart from the first burner on the panel. A frame of the cooktop appliance is removably mounted to the panel. The frame is configured to selectively support two or more grates or a griddle plate over the first burner and the second burner. The cooktop appliance may include a first pogo pin terminal block positioned on the panel adjacent to the first burner and a second pogo pin terminal block positioned on the panel adjacent to the second burner. The frame may include a first sleeve which encloses first connectors of the first pogo pin terminal block and a second sleeve which encloses second connectors of the second pogo pin terminal block on four sides. The griddle plate or the grates may include two or more embedded temperature sensors.

19 Claims, 13 Drawing Sheets

COOKTOP APPLIANCE WITH MODULAR GRIDDLE SYSTEM

FIELD OF THE INVENTION

The present subjection matter relates generally to cooktop appliances, such as cooktop appliances with multiple gas burners for heating a griddle assembly.

BACKGROUND OF THE INVENTION

Cooking appliances, e.g., cooktops or ranges (also known as hobs or stoves), generally include one or more heated portions for heating or cooking food items within or on a cooking utensil placed on the heated portion. For instance, burners may be included with each heated portion. The heated portions utilize one or more heating sources to output heat, which is transferred to the cooking utensil and thereby to any food item or items that are disposed on or within the cooking utensil. For instance, a griddle may be provided to extend across one or more heated portions. When disposed above the heated portion, the griddle generally provides a substantially flat cooking surface.

Although a griddle may provide a flat cooking surface, difficulties may arise in dispersing or spreading heat across the flat cooking surface. Generally, heat from the burners of the appliance is directly transferred to the griddle according to the footprint of the burner. In turn, heat may be uneven across various portions of the flat cooktop surface. This may result in one portion of the flat cooking surface being heated to a significantly higher temperature than the rest of the flat cooking surface (i.e., creating "hot spots"). If the griddle extends over multiple burners, such hot spots may be increasingly problematic and cause food items thereon to be cooked unevenly. It can be difficult to balance the heat output of multiple burners. Moreover, since the relative heat output of the multiple burners may vary, a user may accidentally overheat the griddle and/or food thereon.

Some existing systems have attempted to address these issues by including a single elongated burner over which a griddle may be arranged. For example, certain gas cooktop appliances with integrated griddles include an elongated burner for more evenly heating the integrated griddle. However, elongated burners can provide limited utility outside of heating griddles. Also, consumers generally only use griddles occasionally. Moreover, a size of integrated griddles may be limited due to the need to center the integrated griddle over the gas burners. Integrated griddles can also block a significant portion of airflow to the gas burner as well as exhaust from the gas burner, which leads to poor combustion and excessive heating of cooktop components.

Accordingly, a gas cooktop appliance with features for evenly heating a removable griddle would be useful. In particular, a gas cooktop appliance with features for evenly heating a large griddle across multiple burners would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a cooktop appliance is provided. The cooktop appliance includes a panel having a top surface and a bottom surface. A first burner is disposed on the panel and a second burner is spaced apart from the first burner on the panel. The cooktop appliance also includes a first pogo pin terminal block positioned on the panel adjacent to the first burner and a second pogo pin terminal block positioned on the panel adjacent to the second burner. The cooktop appliance further includes a frame removably mounted to the top surface of the panel. The frame includes a first sleeve which encloses first connectors of the first pogo pin terminal block on four sides when the frame is mounted to the top surface of the panel and a second sleeve which encloses second connectors of the second pogo pin terminal block on four sides when the frame is mounted to the top surface of the panel. The frame is configured to selectively support two or more grates over the first burner and the second burner or a griddle plate over the first burner and the second burner.

In another aspect of the present disclosure, a cooktop appliance is provided. The cooktop appliance includes a panel having a top surface and a bottom surface. A first burner is disposed on the panel and a second burner is spaced apart from the first burner on the panel. The cooktop appliance further includes a frame removably mounted to the top surface of the panel. The frame spans the first burner and the second burner. The cooktop appliance also includes a griddle plate positioned on the frame above the first burner and the second burner. The griddle plate includes a first embedded temperature sensor above the first burner and a second embedded temperature sensor above the second burner.

In yet another aspect of the present disclosure, a cooktop appliance is provided. The cooktop appliance includes a panel having a top surface and a bottom surface. A first burner is disposed on the panel and a second burner is spaced apart from the first burner on the panel. The cooktop appliance further includes a frame removably mounted to the top surface of the panel. The frame spans the first burner and the second burner. The cooktop appliance also includes a first grate positioned on the frame above the first burner and a second grate positioned on the frame above the second burner. The first grate includes a first plurality of fingers. The first plurality of fingers includes a first sensor finger with a first temperature sensor embedded in the first sensor finger above the first burner. The second grate includes a second plurality of fingers. The second plurality of fingers includes a second embedded temperature sensor above the second burner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
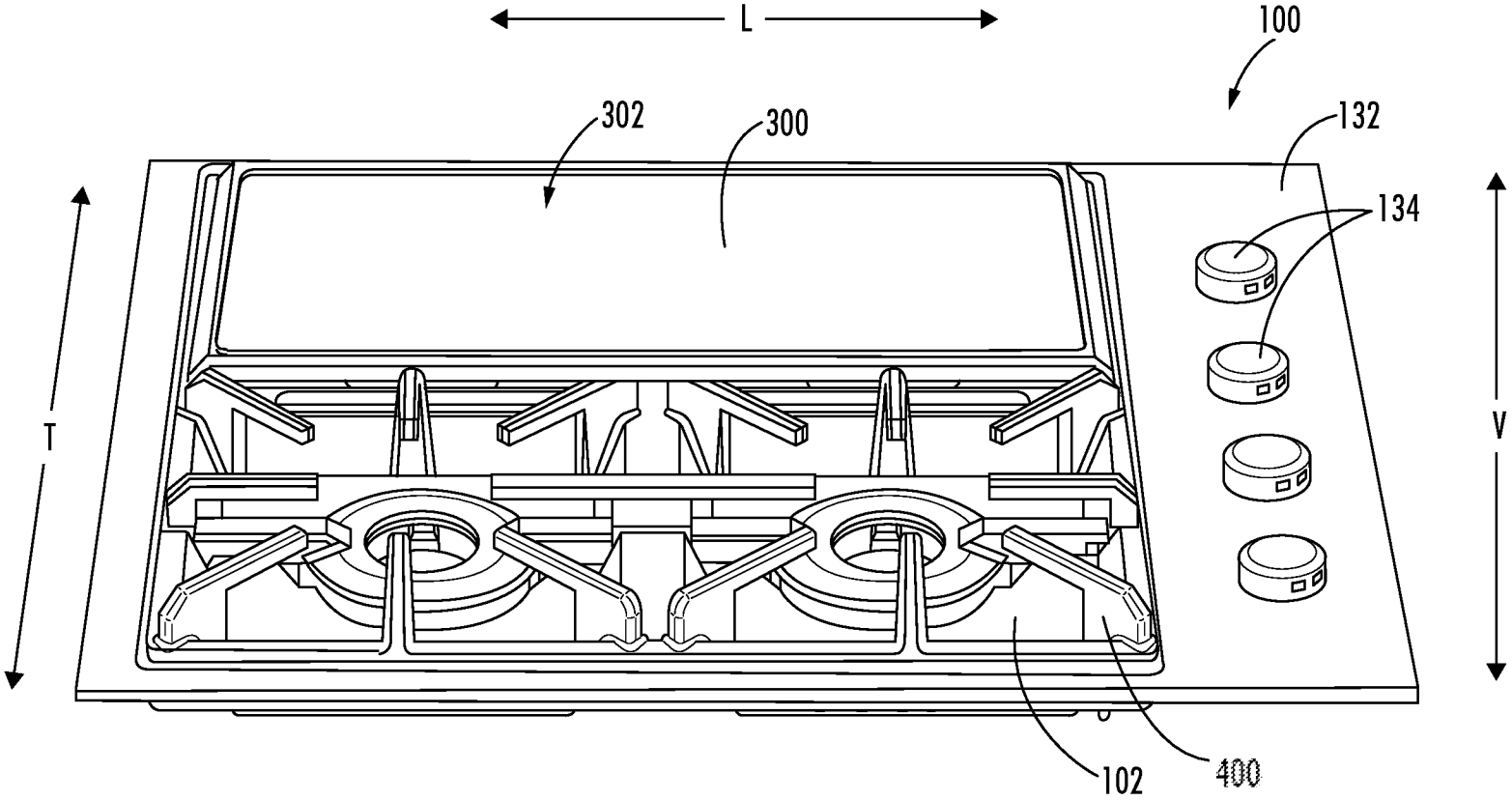
FIG. 1 provides a perspective view of a cooktop appliance according to one or more example embodiments of the present disclosure.
Figure 2:
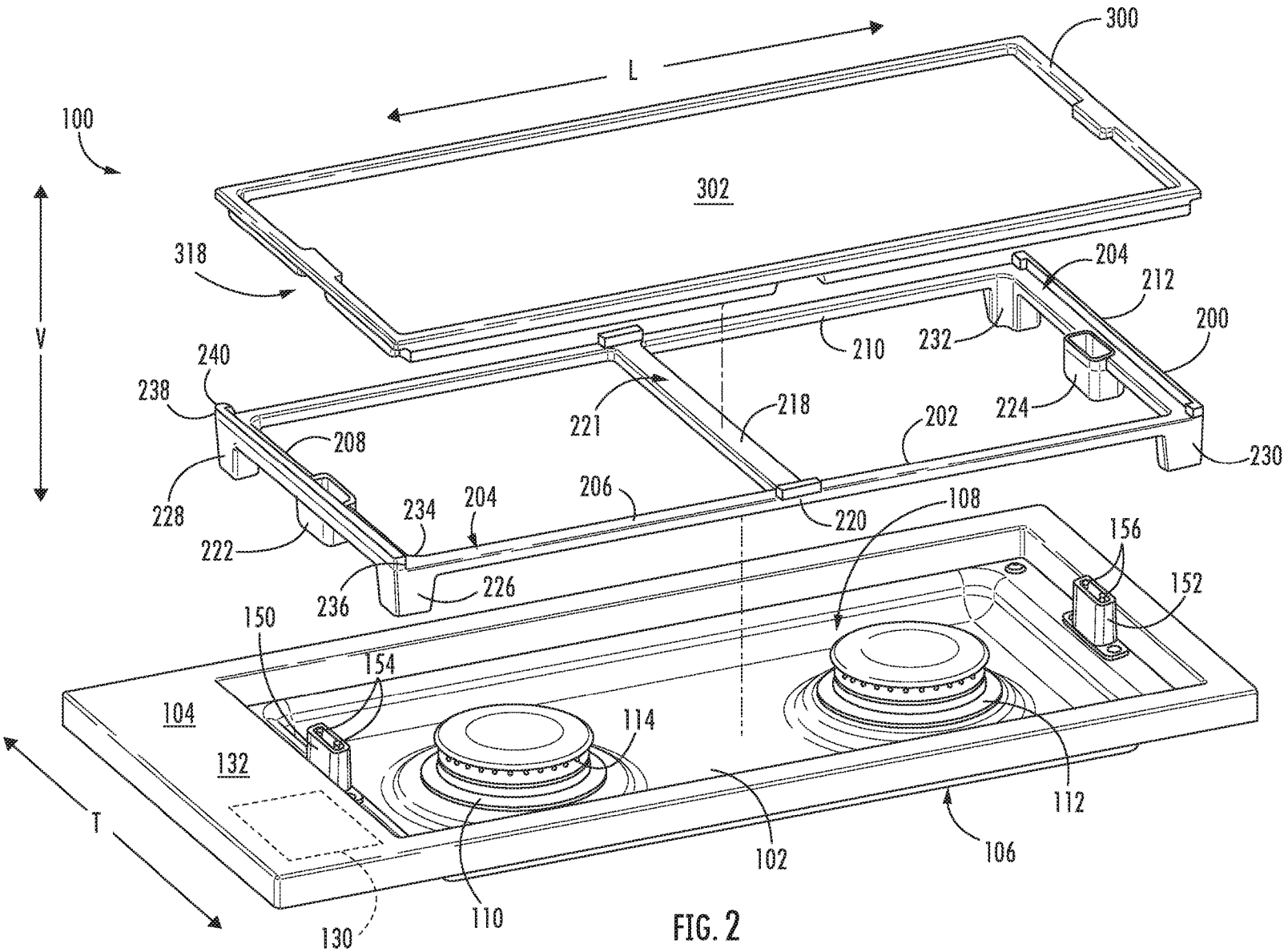
FIG. 2 provides an exploded view of the example cooktop appliance of FIG. 1.
Figure 3:
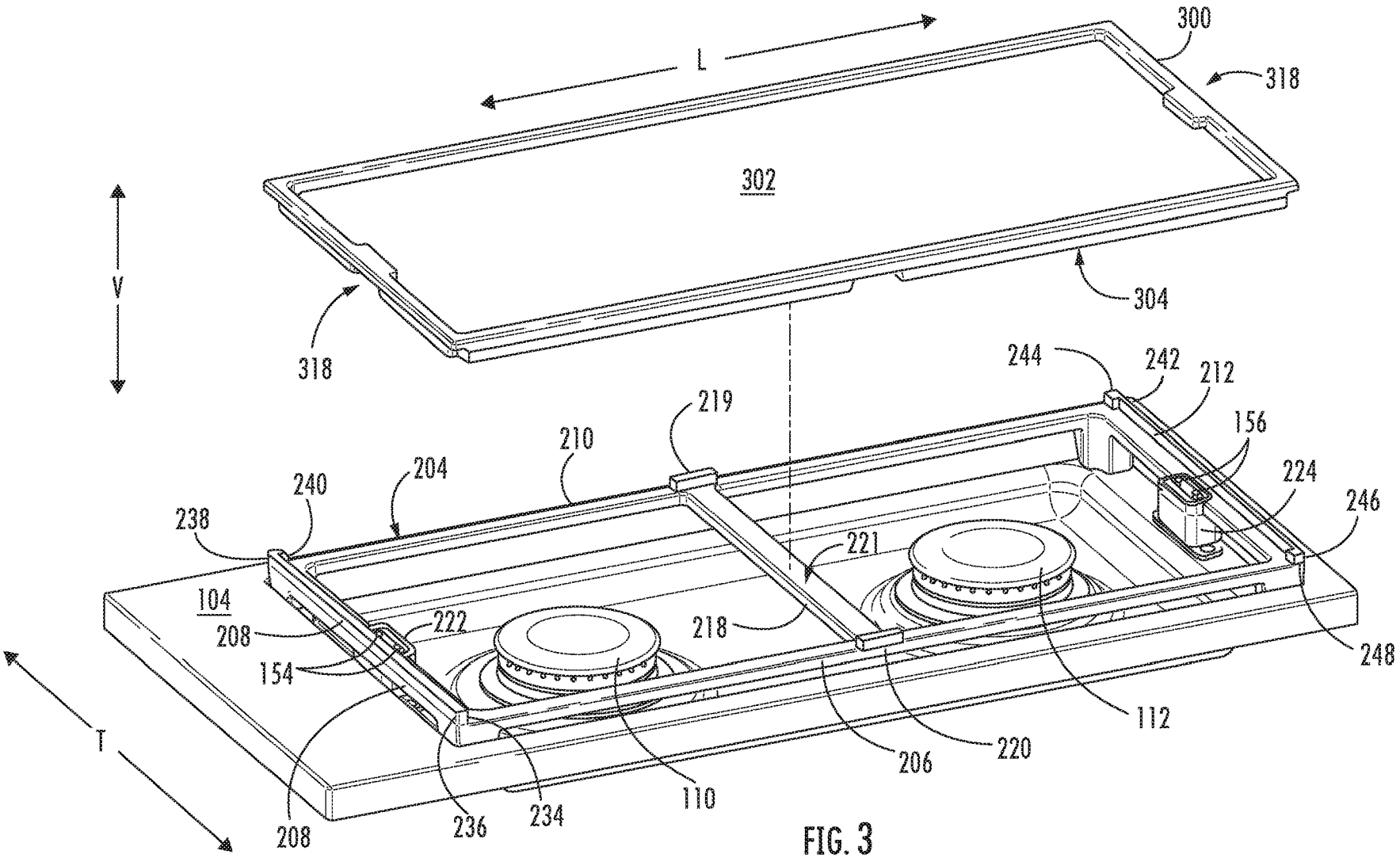
FIG. 3 provides a partially exploded view of the example cooktop appliance of FIG. 1.
Figure 4:
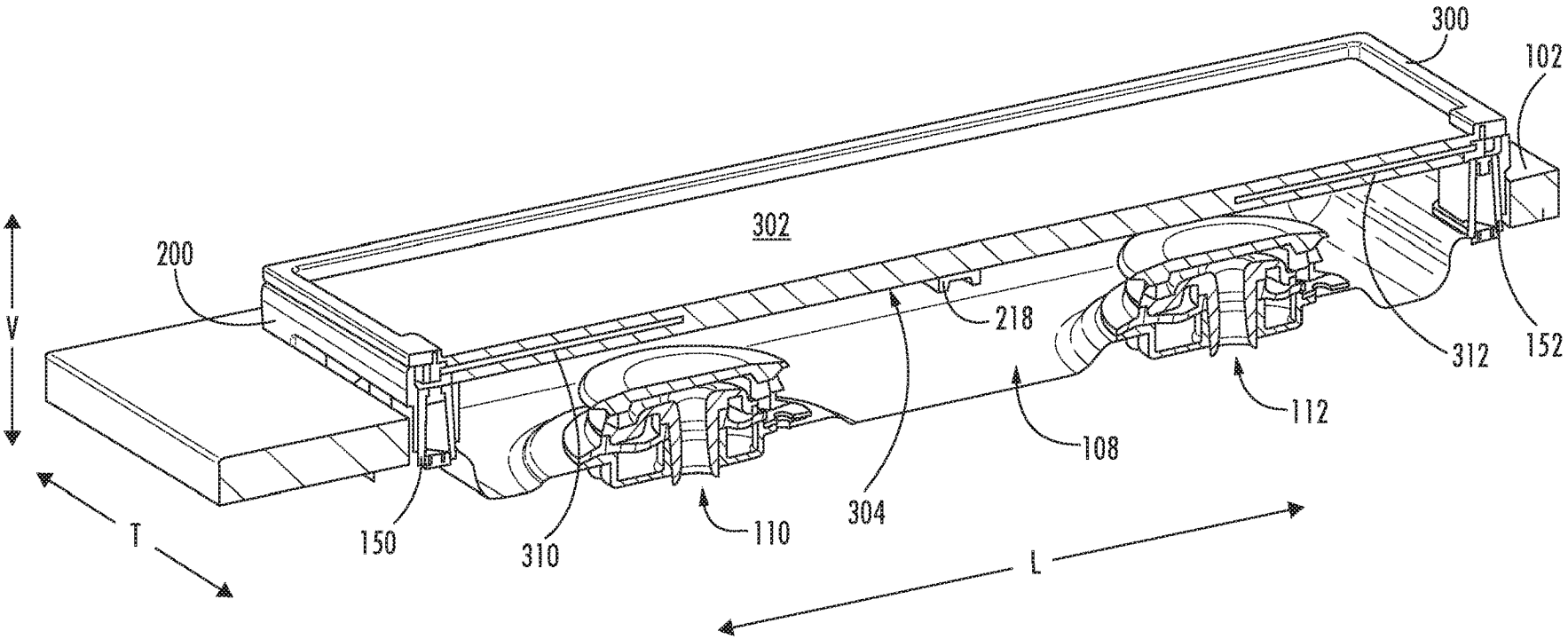
FIG. 4 provides a longitudinal section view of the example cooktop appliance of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

In some aspects of the present disclosure, a cooktop appliance having a modular griddle system, e.g., where the cooktop appliance includes features for quickly and easily swapping out a griddle plate or two or more grates over two or more burners of the cooktop appliance is provided. Generally, and as will be described in detail below, the cooktop appliance may include a frame which is configured to receive and support either the griddle plate or the two or more grates.

FIGS. 1 through 13 illustrate one or more example embodiments of a cooktop appliance 100 according to the present disclosure. The example cooktop appliance 100 includes a panel 102 that extends in a lateral direction L and a transverse direction T, e.g., perpendicular to a vertical direction V. Each of the vertical direction V, lateral direction L, and transverse direction T is mutually perpendicular to every other of the vertical direction V, the lateral direction L, and the transverse direction T, such that an orthogonal direction system is formed. The panel 102 may include a top surface 104 and a bottom surface 106. By way of example, the panel 102 may be constructed of enameled steel, stainless steel, glass, ceramics, and combinations thereof.

As may be seen, e.g., in FIGS. 1-4, 7, and 10, the cooktop appliance 100 may include a plurality of burners. For example, the cooktop appliance 100 may include a first burner 110 disposed on the panel 102 and a second burner 112 spaced apart from the first burner 110 on the panel 102. For example, as illustrated, the first burner 110 and the second burner 112 may be aligned along the transverse direction T and spaced apart along the lateral direction L. The panel 102 may also include a recessed portion 108, e.g., which extends downward along the vertical direction V. The first and second burners 110 and 112 may be positioned within the recessed portion 108. The recessed portion 108 may collect spilled material, e.g., foodstuffs, during operation of the cooktop appliance.

The cooktop appliance 100 may also include a user interface panel 132 located within convenient reach of a user of the cooktop appliance 100. In various embodiments, the user interface panel may include user inputs 134, such as knobs, buttons, or a touchscreen, etc., which are generally understood by those of ordinary skill in the art and are therefore not shown or described in extensive detail herein for the sake of brevity and clarity. The user inputs 134 may allow the user to activate one or more burners and determine an amount of heat provided by each gas burner. The user interface panel 132 may also be provided with one or more graphical display devices that deliver certain information to the user, e.g., whether a particular burner is activated and/or the level at which the burner is set.

Operation of the cooktop appliance 100 can be regulated by a controller 130 that is operably coupled to (i.e., in operative communication with) the user inputs and/or gas burners. For example, in response to user manipulation of the user input(s), the controller 130 operates one or more of the burners 110, 112. By way of example, the controller 130 may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In some embodiments, the processor may execute non-transitory programming instructions stored in memory. For example, the instructions may include a software package configured to operate appliance 100 and execute an operation routine such as one or more methods of operating the cooktop appliance. The memory may be a separate component from the processor or may be included onboard within the processor.

The controller 130 may be disposed in a variety of locations throughout appliance 100. Input/output ("I/O") signals may be routed between the controller 130 and various operational components of appliance 100, such as the gas burners 110, 112, inputs, a graphical display, one or more sensors, and/or one or more alarms.

Figure 5:
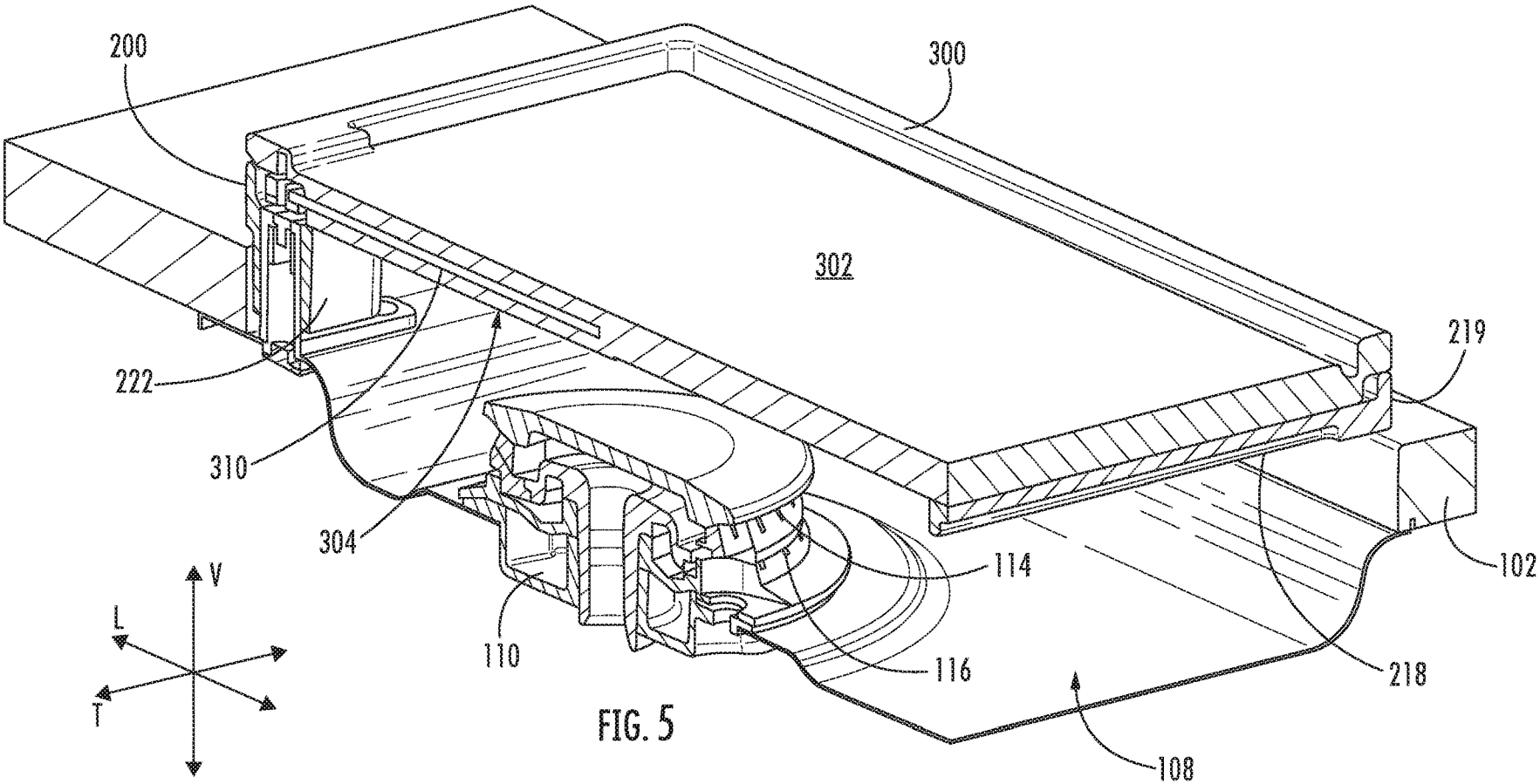
FIG. 5 provides a sectional view of a portion of the cooktop appliance of FIG. 1.

Generally, each gas burner 110, 112 includes a generally circular shape from which a flame may be emitted. As shown, each gas burner 110, 112 includes a plurality of fuel ports 114 is defined circumferentially in fluid communication with an internal passage of each respective burner 110, 112. In some embodiments, e.g., as illustrated in FIG. 5, one or both of the first burner 110 and the second burner 112 may be a multi-ring burner. For example, as illustrated in FIG. 5, the first burner 110 may include a first plurality of fuel ports 114 defining a first ring of the burner 110 and a second plurality of fuel ports 116 defining a second ring of the burner 110. In such embodiments, a first fuel chamber in fluid communication with the first plurality of fuel ports 114 may be separated from a second fuel chamber in fluid communication with the second plurality of fuel ports 116 by a wall within the burner 110, and the burner may be configured to selectively supply fuel to one or both of the fuel chambers. In some embodiments of a cooktop appliance, multiple burners of differing types may be provided in combination, e.g., one or more single-ring burners as well as one or more multi-ring burners. Moreover, other suitable burner configurations are also possible.

As will be described in more detail below, the cooktop appliance 100 may be modular, e.g., may be configured for selectively receiving two or more grates or a griddle plate over the burners. Additionally, the cooktop appliance may be configured for closed-loop cooking. For example, the controller 130 may be operable to receive a set temperature (such as from a user input of the cooktop appliance 100 or wirelessly from a remote device such as a smartphone) and to compare the set temperature to temperature measurements from one or more temperature sensors, such as a temperature sensor associated with each burner, and to automatically adjust each burner, such as a fuel flow rate to each burner, based on the comparison of the corresponding temperature measurement to the set temperature.

Thus, the controller 130 may be in operative communication with one or more temperature sensors. For example, the controller 130 may be selectively in operative communication with embedded temperature sensors 310, 312 in a griddle plate 300 or embedded temperature sensors 450 in two or more grates 400, 402 via pogo pin terminal blocks positioned on, e.g., mounted to, the panel 102. In some embodiments, the cooktop appliance 100 may therefore include a first pogo pin terminal block 150 and a second pogo pin terminal block 152.

Figure 8:
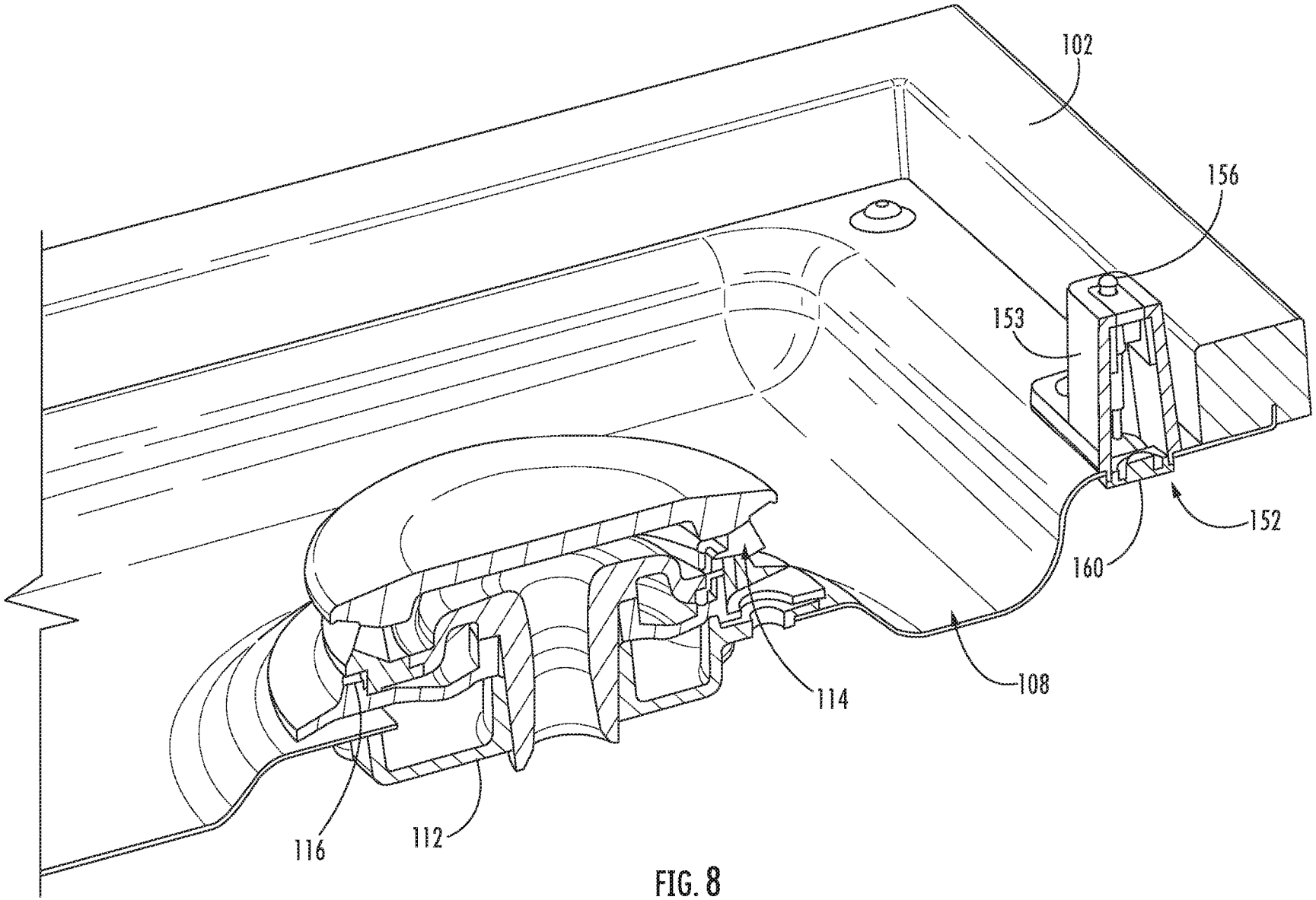
FIG. 8 provides an enlarged section view of a portion of the top panel of FIG. 7.
Figure 9:
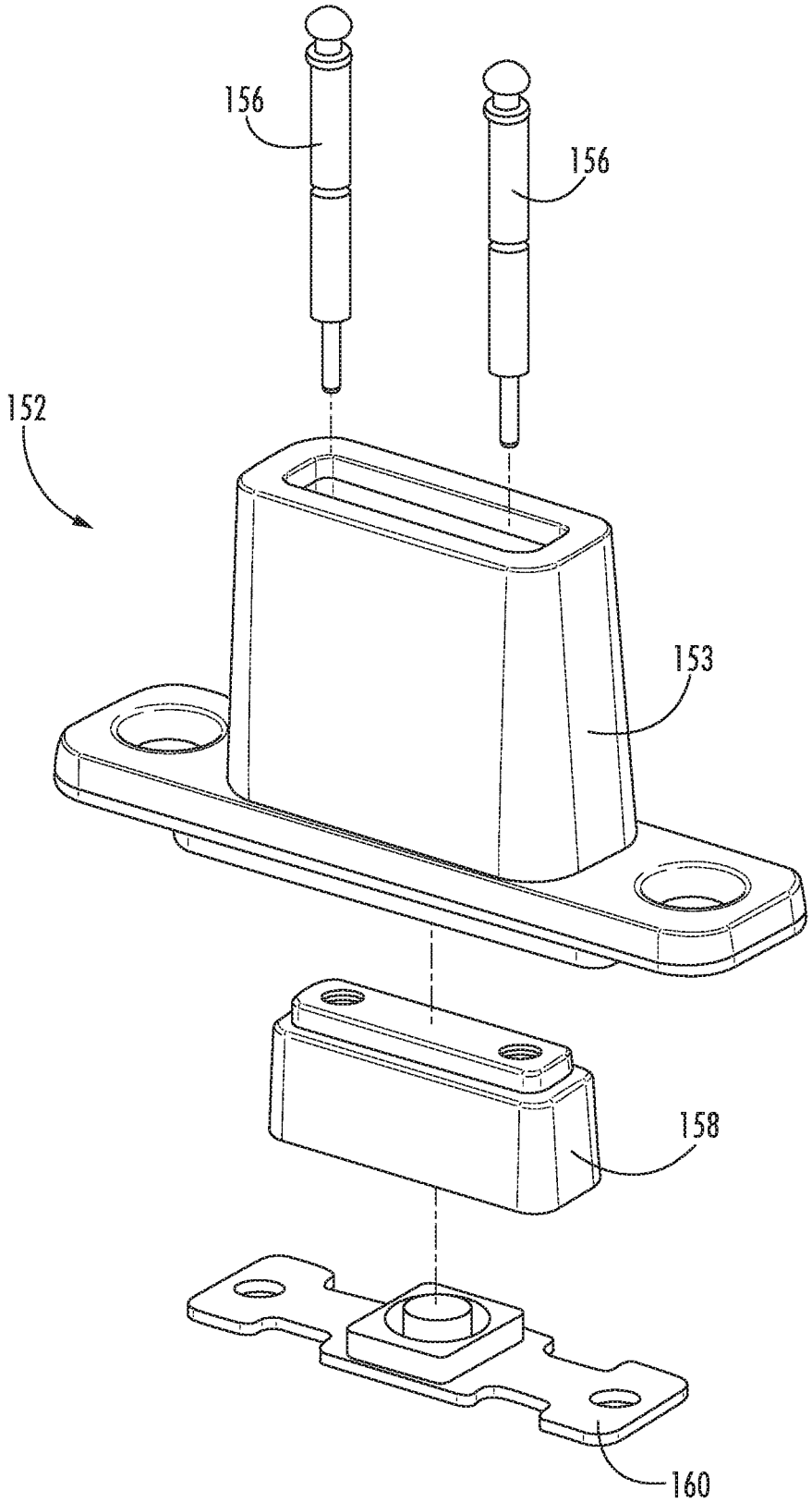
FIG. 9 provides an exploded view of a pogo pin terminal block such as may be incorporated into a cooktop appliance according to one or more embodiments of the present disclosure.
Figure 10:
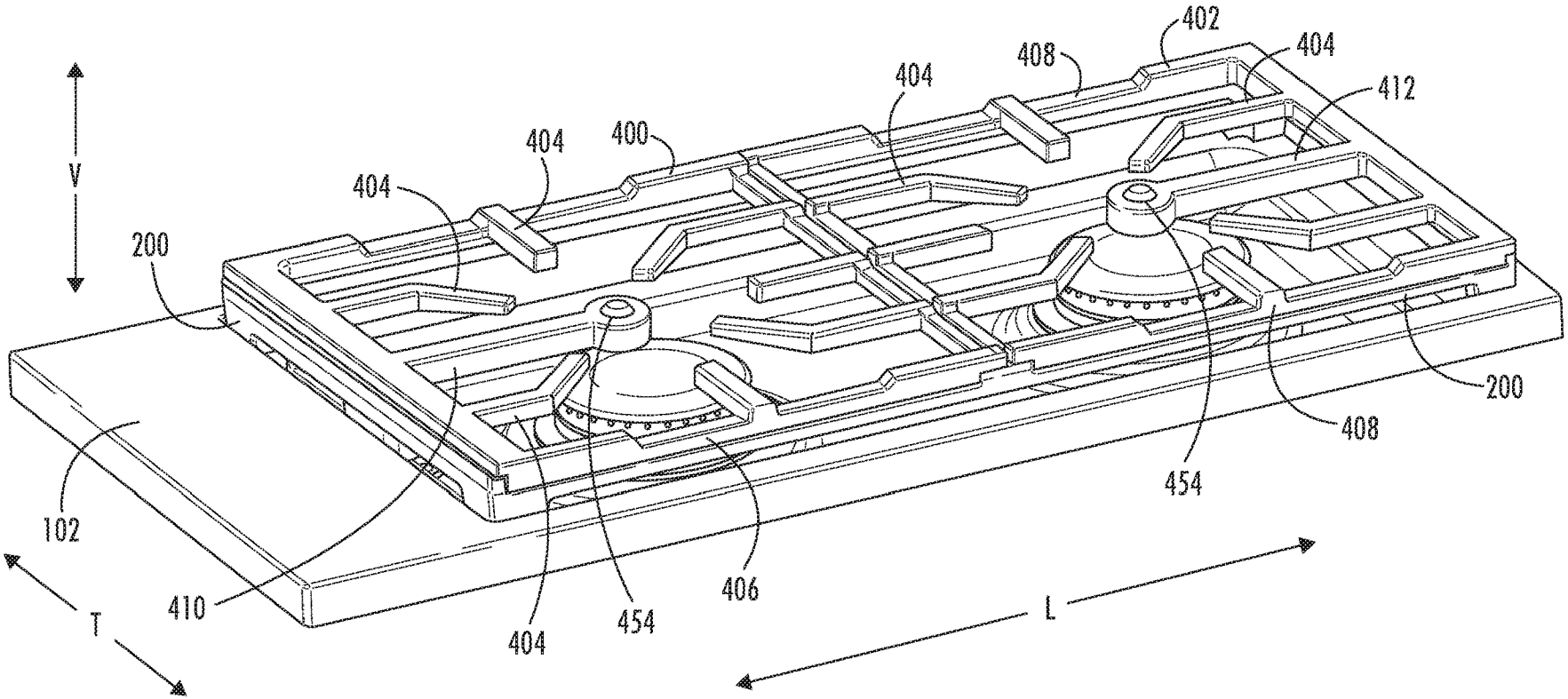
FIG. 10 provides a perspective view of a cooktop appliance according to one or more example embodiments of the present disclosure.
Figure 11:
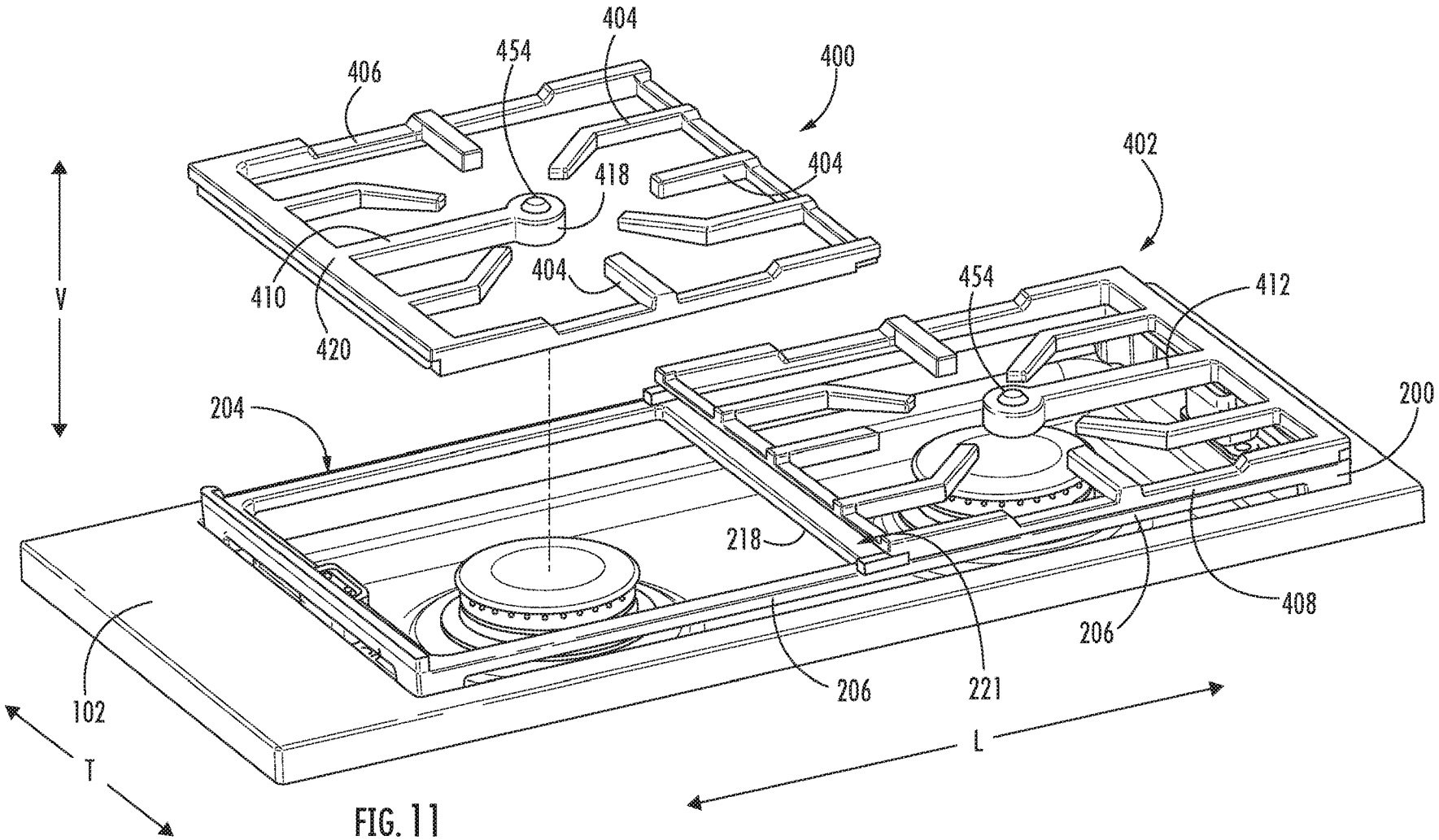
FIG. 11 provides a partially exploded view of the example cooktop appliance of FIG. 10.

As best seen in FIGS. 8 and 9, the first and second connectors 154 and 156 of the first pogo pin terminal block 150 and second pogo pin terminal block 152 may be positioned in a housing 153 mounted on the panel 102, e.g., where the housing 153 is on and extending from the top surface 104 of the panel 102, such that the housing 153 elevates the respective connectors 154, 156 of each pogo pin terminal block 150 or 152 above the top surface 104 of the panel 102. Also as illustrated in FIG. 9, each pogo pin terminal block 150, 152 may include a connector block 158 and a baseplate 160. Only the second pogo pin terminal block 152 is illustrated in FIGS. 8 and 9, although it should be understood that the first and second pogo pin terminal blocks 150 and 152 are substantially identical, e.g., apart from their respective locations.

In some embodiments, the first pogo pin terminal block 150 may be positioned on the panel 102 adjacent to the first burner 110 and the second pogo pin terminal block 152 may be positioned on the panel 102 adjacent to the second burner 112. For example, the first pogo pin terminal block 150 may be positioned opposite the second burner 112, e.g., about the first burner 110, along the lateral direction L, and the second pogo pin terminal block 152 may be positioned opposite the first burner 110, e.g., about the second burner 112, along the lateral direction L. As mentioned above, the first burner 110 and the second burner 112 may be aligned with each other along the transverse direction T. In such embodiments, the first pogo pin terminal block 150 may be aligned with the first burner 110 along the transverse direction T and the second pogo pin terminal block 152 may be aligned with the second burner 112 along the transverse direction T. Thus, in some embodiments, the first burner 110 and the second burner 112 may be aligned with each other and with the first pogo pin terminal block 150 and the second pogo pin terminal block 152 along the transverse direction T.

The first pogo pin terminal block 150 and the second pogo pin terminal block 152 may each include at least two connectors, such as at least two spring loaded pins or at least two contact pads. For example, the first pogo pin terminal block 150 may include first connectors 154, e.g., two spring-loaded pins 154 in the illustrated example embodiment, and the second pogo pin terminal block 152 may include second connectors 156, e.g., a second pair of spring-loaded pins 156, where the illustrated spring-loaded pins are an example embodiment of first and second connectors 154 and 156 of the first and second pogo pin terminal blocks 150 and 152. In some embodiments, the first connectors 154 and the second connectors 156 may be positioned above the first burner 110 and the second burner 112 along the vertical direction V. In some embodiments, the first connectors 154 and the second connectors 156 may be positioned outside of, e.g., above along the vertical direction V, the recessed portion 108 of the panel 102. Thus, the connectors 154 and 156 may be protected from spillage, e.g., by positioning the connectors 154 and 156 above the recessed portion 108 of the panel 102 and/or by enclosing the connectors 154 and 156, where example embodiments of enclosing the connectors 154 and 156 will be described below.

The cooktop appliance 100 may also include a frame 200 which may be mounted, such as removably mounted, to the top surface 104 of the panel 102. The frame 200 may be configured to selectively support two or more grates 400, 402 (FIGS. 10 and 11) over the first burner 110 and the second burner 112 or a griddle plate 300 (FIGS. 1 through 5) over the first burner 110 and the second burner 112.

The frame 200 may thusly be positioned above the first burner 110 and the second burner 112, e.g., along the vertical direction V. For instance, in some embodiments, the frame 200 may span the two burners 110 and 112, e.g., the frame 200 may consist of a single piece spanning unsupported across the first burner 110 and the second burner 112.

The frame 200 may include a first sleeve 222 which encloses the first connectors 154 of the first pogo pin terminal block 150 on four sides when the frame 200 is mounted to the top surface 104 of the panel 102 and a second sleeve 224 which encloses the second connectors 156 of the second pogo pin terminal block 152 on four sides when the frame 200 is mounted to the top surface 104 of the panel 102.

For example, the frame 200 may include or consist of four corners, and may have a leg extending generally along the vertical direction V at each corner. The sleeves 222 and 224 of the frame 200 may be positioned between the corners, e.g., between the legs. The legs of the frame 200 may be positioned on panel 102, e.g., may extend from an outer rail 202 of the frame 200 to the top surface 104 of panel 102 when the frame 200 is mounted on the panel 102. In some embodiments, the frame 200 may include a first leg 226 and a second 228 leg positioned opposite the first leg 226 along the transverse direction T. For example, the first leg 226 and the second leg 228 may be aligned with the first sleeve 222 along the transverse direction T with the first sleeve 222 positioned between the first leg 226 and the second leg 228.

In some embodiments, the frame 200 may further include a third leg 230 and a fourth leg 232 positioned opposite the third leg 230 along the transverse direction T. For example, the third leg 230 and the fourth leg 232 may be aligned with the second sleeve 224 along the transverse direction T with the second sleeve 224 positioned between the third leg 230 and the fourth leg 232.

The first leg 226 and the second leg 228 may be disposed on the frame 200 opposite the third leg 230 and fourth leg 232 along the lateral direction L. In some embodiments, the frame 200 may span unsupported across the first burner 110 and the second burner 112, e.g., without any legs or other portions of the frame 200 resting on the panel 102 between the legs 226, 228, 230, and 232, and/or between the burners 110 and 112, along the lateral direction L. The first burner 110 and the second burner 112 may be positioned between the first leg 226 and the third leg 230 along the lateral direction L when the frame 200 is mounted to the top surface 104 of the panel 102. For example, the burners 110 and 112 may be between the first pair of legs, e.g., the first and second legs 226 and 228, and the second pair of legs, e.g., the third and fourth legs 230 and 232, along the lateral direction L.

As mentioned, the frame 200 may include an outer rail 202. The outer rail 202 of the frame may extend around a perimeter of the frame, such as completely around the entire perimeter of the frame 200 and may define a peripheral support surface 204, e.g., for at least partially supporting the griddle 300 or grates 400, 402 thereon. For example, the peripheral support surface 204 may be configured to selectively support a first grate 400 on a first portion, e.g., half, of the peripheral support 204 surface and a second grate 402 on a second portion, e.g., a second half, of the peripheral support surface 204 adjacent to the first portion, or a griddle plate 300 on the entire peripheral support surface 204.

In some embodiments, the outer rail 202 of the frame 200 comprises a front portion 206, a left side portion 208, a back portion 210 parallel to the front portion 206, and a right side portion 212 parallel to the left side portion 208. The front portion 206 and the back portion 210 may be spaced apart by the left side portion 208 and the right side portion 212, e.g., the back portion 210 may be positioned at an opposite end of each of the left side portion 208 and the right side portion 212 from the front portion 206. The left side portion 208 and the right side portion 212 may each extend perpendicular to the front portion 206 and the back portion 210. For example, the left side portion 208 may extend from a left end 234 of the front portion 206 at a front end 236 of the left side portion 208 to a back end 238 of the left side portion 209. The back portion 210 may extend from the back end 238 of the left side portion 208 at a left end 240 of the back portion 210 to a back end 242 of the right side portion 212 at a right end 244 of the back portion 210. The right side portion 212 may extend from the back end 242 of the right side portion 212 to a front end 246 of the right side portion 212 at a right end 248 of the front portion 206.

The frame 200 may also include a crossbar 218 extending through the frame 200 at about the middle of the frame 200. For example, the crossbar 218 may extend from a midpoint 220 of the front portion 206 to a midpoint 219 of the back portion 210. In some embodiments, the peripheral support surface 204 may be defined along the front portion 206, the left side portion 208, the back portion 210, and the right side portion 212, and the crossbar 218 may define an intermediate support surface 221. The intermediate support surface 221 may be configured to selectively support the first grate 400 at a first side of the intermediate support surface 221 and the second grate 402 at a second side of the intermediate support surface 221 or to support a middle section of the griddle plate 300.

The frame 200 may be formed of cast metal, such as cast iron or aluminum, such that the outer rail 202, cross-bar 218, legs 226, 228, 230, and 232, and sleeves 222 and 224 are formed from a single, seamless piece of metal. Frame 200 may be removable from panel 102, e.g., by lifting upwardly on the frame 200.

Moreover, it is understood that further additional or alternative embodiments of the frame 200 may be placed over more than two burner assemblies, e.g., to permit a griddle plate positioned on the frame 200 to receive heat output from three or more burner assemblies.

As generally indicated across FIGS. 1 through 5, the frame 200 may be configured to selectively receive a griddle plate 300 (e.g., in a mounted position). For instance, the griddle plate 300 may be selectively disposed on frame 200 to receive heat from two or more discrete gas burner assemblies, e.g., the first and second burners 110 and 112.

As shown in FIGS. 1 through 5 the griddle plate 300 may be disposed on the frame 200 over top panel 102 (e.g., along the vertical direction V) in a mounted position. Griddle plate 300 defines a top cooking surface 302 and a bottom heating surface 304 below and beneath top cooking surface 302. For example, as illustrated, the top cooking surface 302 and the bottom heating surface 304 may be spaced apart along the vertical direction V and may be oppositely oriented along the vertical direction V. In example embodiments, griddle plate 30 is a generally planar member. In turn, top cooking surface 302 may be a substantially flat surface. Moreover, one or both of top cooking surface 302 and bottom heating surface 304 may extend perpendicular to the vertical direction V, e.g., in a lateral-transverse plane defined by the lateral direction L and the transverse direction T. Griddle plate 300 may have any suitable shape. For example, griddle plate 300 may be substantially rectangular, e.g., in a plane that is perpendicular to the vertical direction V.

As shown in FIGS. 1 through 4, the griddle plate 300 may be selectively disposed over (e.g., directly above) a corresponding spaced-apart pair of burners, e.g., first gas burner 110 and second gas burner 112. During use, top cooking surface 302 faces away from panel 102 to receive a cooking item (e.g., food) thereon. By contrast, bottom heating surface 304 may be opposite from top cooking surface 302 and faces panel 102 during use. Thus, bottom heating surface 304 may face panel 102 to receive a thermal output (e.g., flame or heated air) from the corresponding burners 110, 112. The bottom surface 304 of the griddle plate 300 may be supported on the frame 200 when the griddle plate 300 is mounted on the frame 200. For example, the bottom surface 304 of the griddle plate 300 may be in contact with the frame 200, such as with the peripheral support surface 204 and the intermediate support surface 221 thereof.

In some embodiments, the griddle plate 300 may include a first embedded temperature sensor 310 and a second embedded temperature sensor 312. For example, when the griddle plate is mounted on the frame 200, the first embedded temperature sensor 310 may be positioned above the first burner 110 and the second embedded temperature sensor 312 may be positioned above the second burner 112. In some embodiments, the first embedded temperature sensor 310 may be positioned directly above the first burner 110 along the vertical direction V and the second embedded temperature sensor 312 may be positioned directly above the second burner 112 along the vertical direction V. The first embedded sensor 310 and the second embedded sensor 312 may be positioned between the bottom surface 304 and the top surface 302 of the griddle plate 300. The embedded sensors 310 and 312 may be spaced apart from each of the bottom surface 304 and the top surface 302 of the griddle plate 300.

Figure 6:
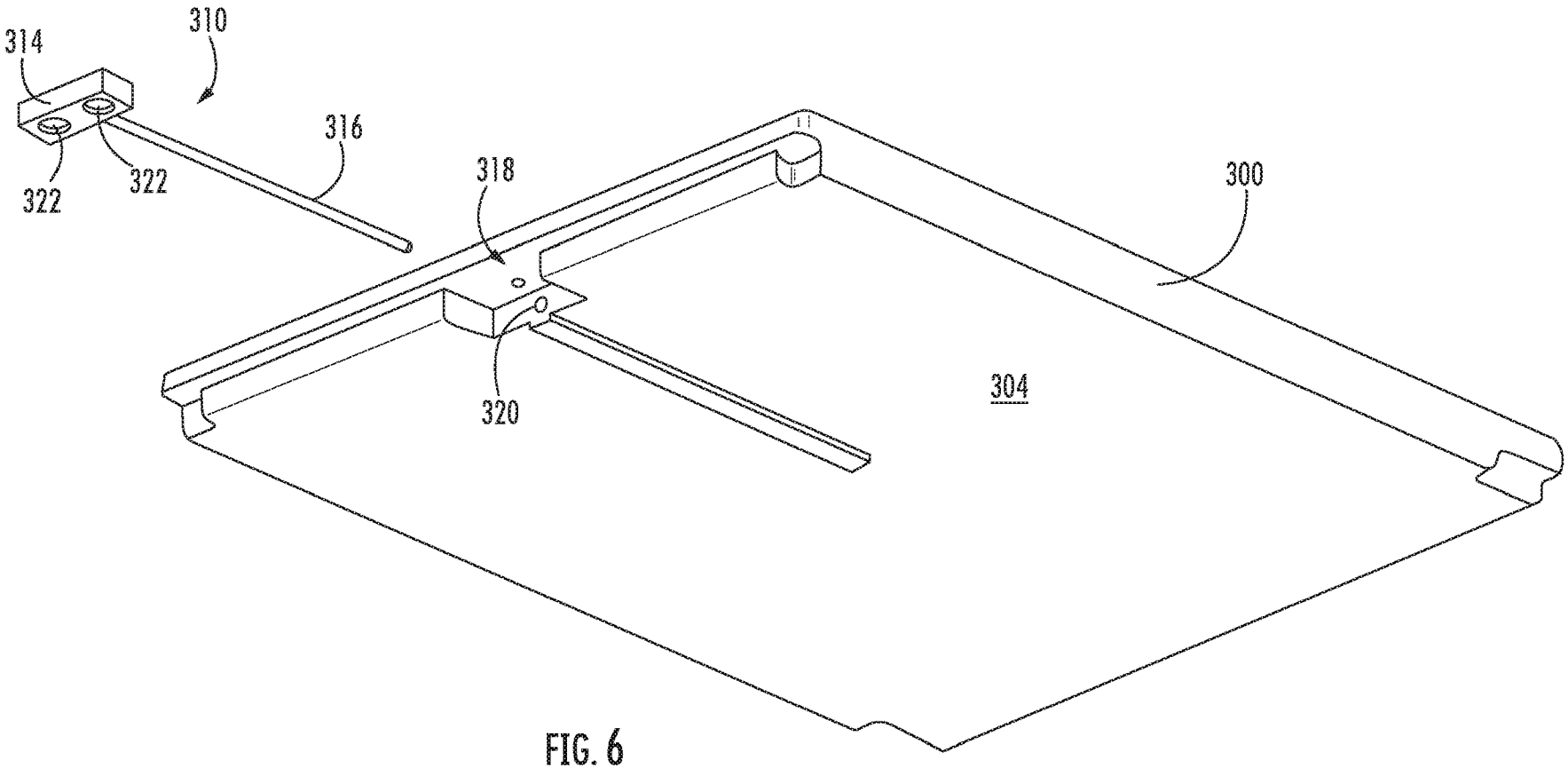
FIG. 6 provides a perspective view of a griddle plate and a temperature sensor therefor such as may be incorporated into a cooktop appliance according to one or more embodiments of the present disclosure.
Figure 7:
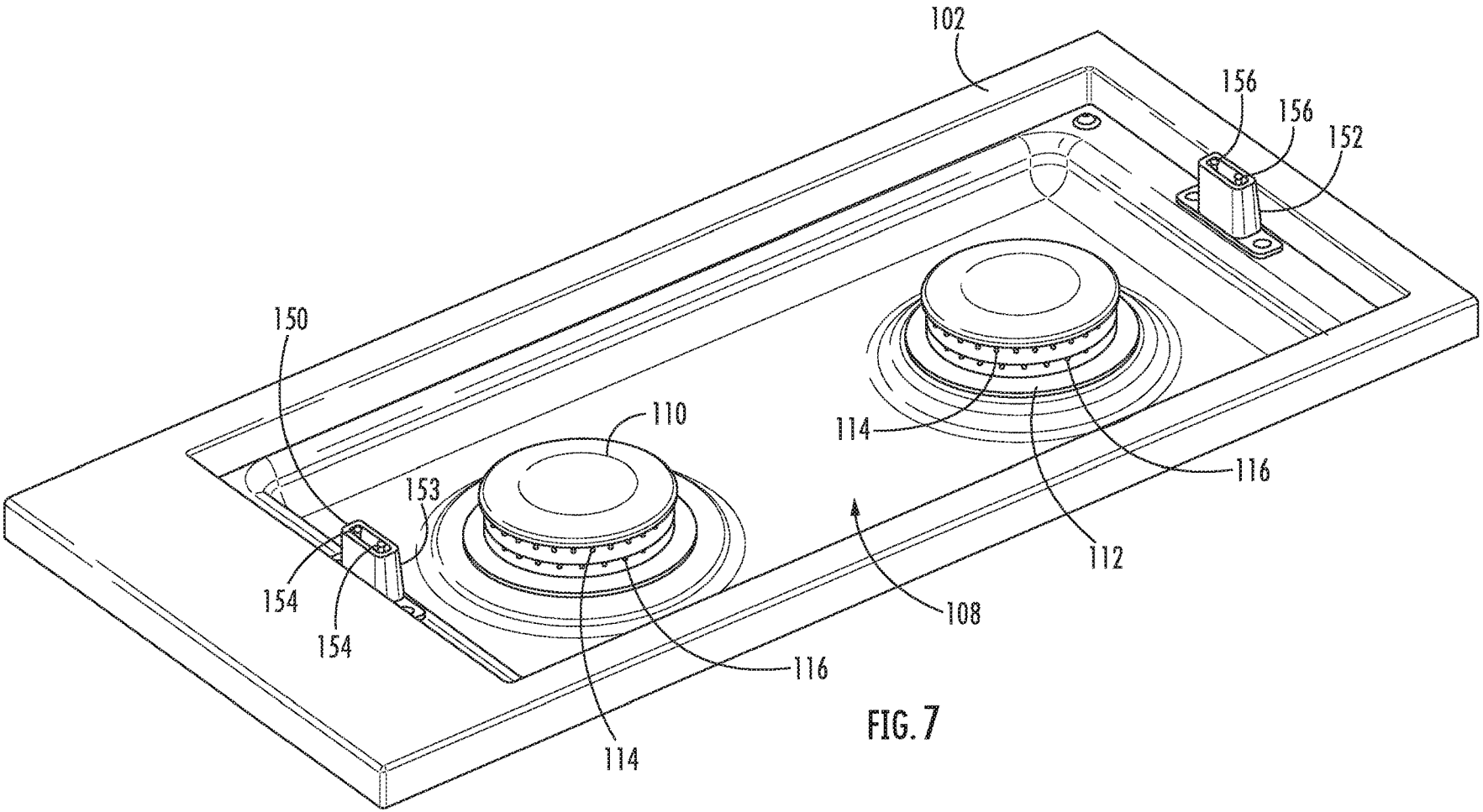
FIG. 7 provides a perspective view of a top panel with first and second burners disposed thereon, such as may be incorporated into a cooktop appliance according to one or more embodiments of the present disclosure.

FIG. 6 provides an exploded view of a portion, e.g., a left half, of the griddle plate 300 with the first embedded temperature sensor 310 removed from the griddle plate 300. Although not specifically illustrated, it should be understood that the second embedded temperature sensor 312 may have the same or similar, e.g., mirrored, features as those depicted for the first embedded temperature sensor 310. In some embodiments, the first embedded temperature sensor 310 may be removable from the griddle plate 300. For example, as illustrated in FIG. 6, the embedded temperature sensor 310 may include a base 314 and a probe 316. The probe 316 may be or include any suitable temperature sensor, such as a thermistor or a thermocouple, among other possible examples. In exemplary embodiments, the probe 316 may include a thermistor, and the thermistor may have a nominal resistance which is distinct from a nominal resistance of a temperature sensor, e.g., thermistor, associated with the grates 400, 402.

Still referring to FIG. 6, the griddle plate 300 may include a recess 318 which receives the base 314 of the first embedded temperature sensor 310 and a bore hole 320 extending partially into the griddle plate 300, e.g., along the lateral direction L, between the top surface 302 and the bottom surface 304 which receives the probe 316 of the first embedded temperature sensor 310. The base 314 of the first embedded temperature sensor 310 may include connectors, such as pogo pin connectors, e.g., contact pads or spring-loaded pins, for example, the base 314 may include two contact pads 322 for connecting with spring-loaded pins 154 of the first pogo pin terminal block 150 or the spring-loaded pins 156 of the second pogo pin terminal block 152 when the griddle plate 300 is mounted on the frame 200 and the frame 200 is mounted on the panel 102. In alternative example embodiments, the relative position of spring loaded pins and contact pads on first and second pogo pin terminal blocks 150, 152 and the base 314 of the or each temperature sensor 310, 312 may be reversed.

Including two embedded sensors 310 and 312 in the griddle plate 300 provides several advantageous features. For example, in some embodiments the first burner 110 and the second burner 112 may be differently sized, such that independently measuring the griddle temperature with a corresponding temperature sensor positioned above the respective burner allows for adjustment of each burner in response to unique conditions at the respective burner. As another example, the food load distributed on the griddle plate 300 may be uneven, such that more heat is required at one portion of the griddle plate 300, e.g., where a meat is being cooked, in contrast with another portion of the griddle plate 300, e.g., where vegetables are being cooked, in order to result in the same temperature at both portions of the griddle plate 300.

As shown in FIGS. 10 through 13, in some embodiments, the cooktop appliance includes one or more grates, e.g., the frame 200 may be configured to receive and support a first and second selectively removable grates 400 and 402. Each grate 400 and 402 may extend at least partially above a corresponding burner 110, 112 when the grates 400 and 402 are in a mounted position on the frame 200 and the frame 200 is mounted on the panel 102. Generally, each grate 400, 402 is configured for supporting a cooking utensil, such as a pot, pan, etc., on top of the grate 400 and/or 402 when the grates 400 and 402 are in the mounted position on the frame 200.

For example, each grate 400 and 402 of the exemplary embodiment includes a plurality of fingers 404, e.g., formed of cast metal, such as cast iron. The cooking utensil may be placed on the fingers 404 of one of the grates 400 and 402 such that the cooking utensil rests on an upper surface of fingers 404. The first grate 400 may include a first outer frame 406 that extends around or defines a perimeter of the first grate 400. The second grate 402 may include a second outer frame 408 that extends around or defines a perimeter of the second grate 402. Thus, each outer frame 406, 408 may be disposed at an outer portion of the respective grate 400 or 402. The fingers 404 of each grate 400 and 402 may extend from the respective outer frame 406 or 408.

When mounted, the grates 400, 402 may selectively rest on the frame 200, such as on the peripheral support surface 204 and the intermediate support surface 221 thereof. For example, the first outer frame 406 may be supported by the left side portion 208, a left half of the front portion 206, a left half of the back portion 210, and a left side of the intermediate support surface 221. In such embodiments, the second outer frame 408 may be supported by the right side portion 212, a right half of the front portion 206, a right half of the back portion 210, and a right side of the intermediate support surface 221.

As shown, the grates 400 and 402 may be selectively removable (e.g., to an unmounted position), such that the grates 400 and 402 can be readily lifted from the frame 200.

Figure 12:
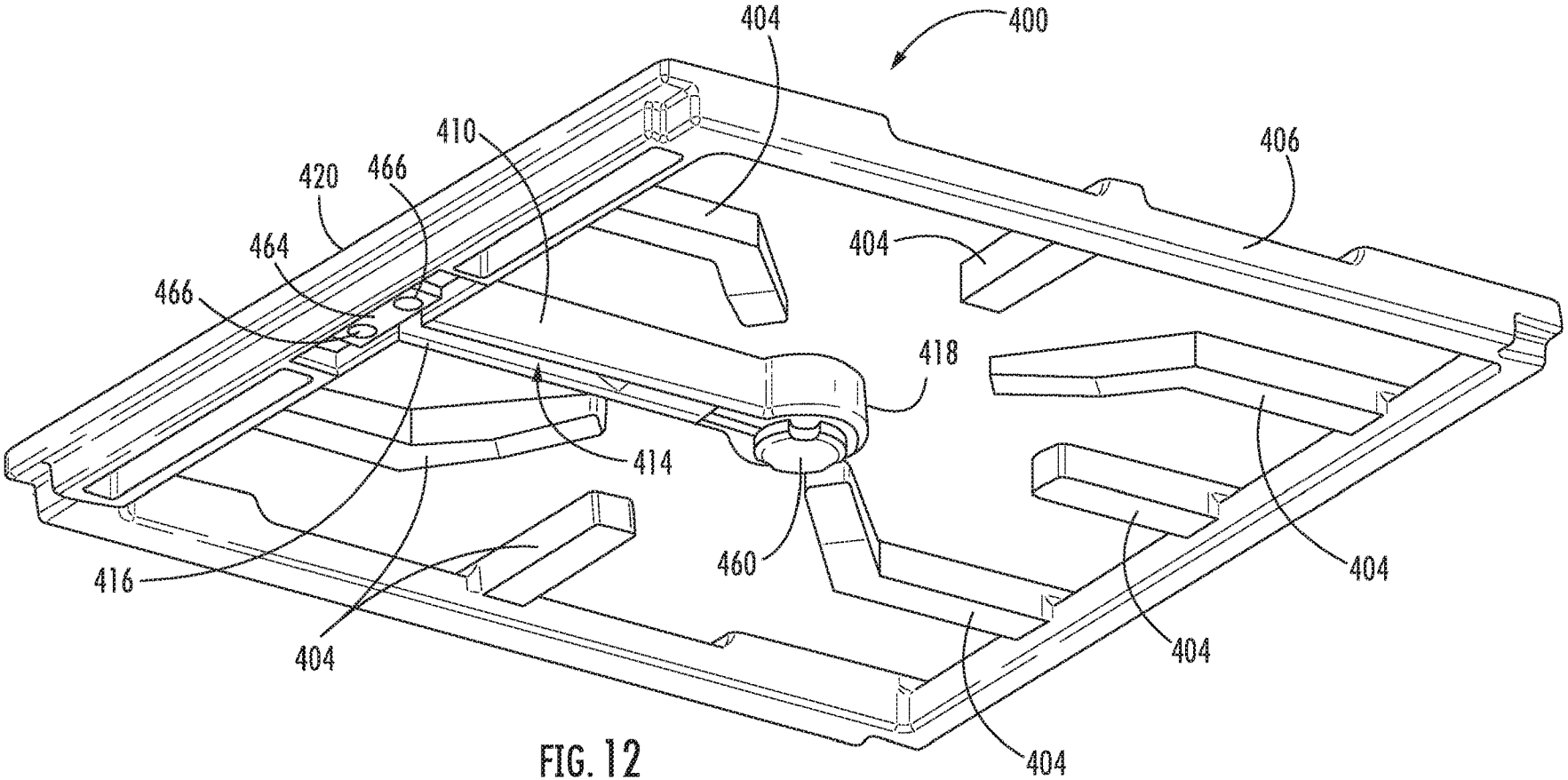
FIG. 12 provides a perspective view of an example grate having an embedded temperature sensor therein as may be incorporated into a cooktop appliance in one or more example embodiments of the present disclosure.
Figure 13:
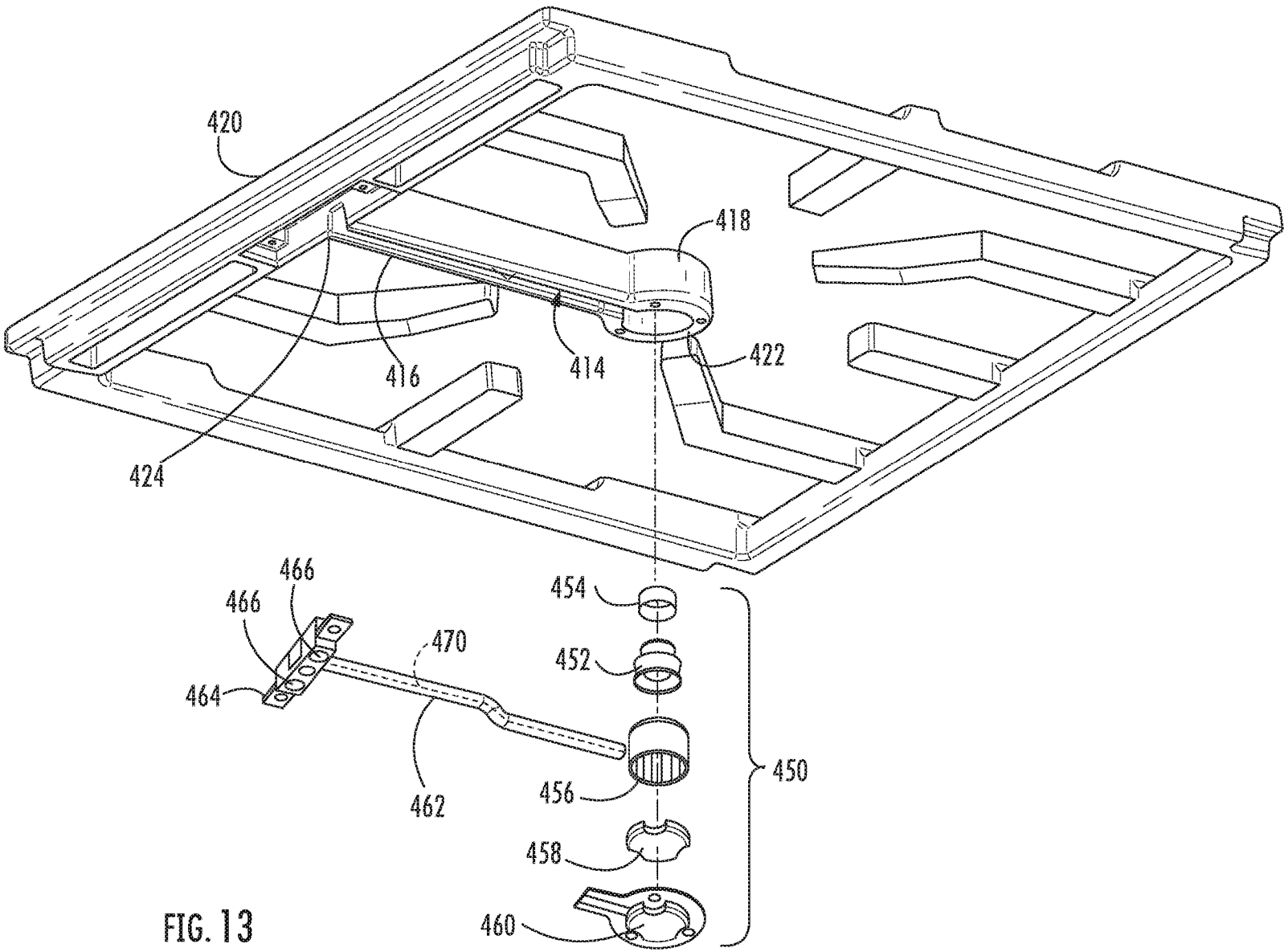
FIG. 13 provides an exploded view of the grate of FIG. 12.

The plurality of fingers 404 includes a first sensor finger 410 on the first grate 400 and a second sensor finger 412 on the second grate 402. As discussed in greater detail below, sensor fingers 410 and 412 each support a temperature sensor 450 that is operable to measure a temperature of a cooking utensil on the respective grate 400 or 402. The first sensor finger 410 is illustrated in FIGS. 12 and 13 and it should be understood that the second sensor finger 412 provides the same or similar, e.g., mirrored, features as those shown and described for first sensor finger 410. As may be seen in FIGS. 12 and 13, the first sensor finger 410 defines a slot 414 at a bottom 416 of the sensor finger 410. Each slot 414 is open and faces downward, e.g., along the vertical direction V, such as towards the panel 102 when the grate 400 is in the mounted position on the panel 102. Thus, slot 414 is exposed and accessible at the bottom 416 of each sensor finger 410, 412.

As best seen in FIGS. 12 and 13, the sensor finger 410 extends between a first end portion 418 and a second end portion 420. In some embodiments, sensor finger 410 may be elongated between the first and second end portions 418, 420 of sensor finger 410. Second end portion 420 of sensor finger 410 may be positioned at the outer frame 406 of the grate 402. Conversely, first end portion 418 of sensor finger 410 may be spaced from the outer frame 406, and may be positioned above the corresponding gas burner 110 or 112 when the grate 400 or 402 is mounted on the frame 200. Slot 414 may also extend between a first end portion 422 and a second end portion 424. First end portion 422 of slot 414 may be positioned at first end portion 418 of sensor finger 410, and second end portion 424 of slot 414 may be positioned at second end portion 420 of sensor finger 410. Thus, slot 414 may extend along the length of sensor finger 410.

Temperature sensor 450 is mounted to sensor finger 410, e.g., within the slot 414 as mentioned above. For example, temperature sensor 450 may be positioned at first end portion 418 of sensor finger 410 and/or first end portion 422 of slot 414. For example, temperature sensor 450 may be positioned over gas burner 110 on sensor finger 410. In particular, temperature sensor 450 may be directly above, e.g., along the vertical direction, the burner 110, and/or may be positioned concentric with gas burner 110 on sensor finger 410. Thus, temperature sensor 450 may be positioned on sensor finger 410 such that temperature sensor 450 is operable to measure and/or detect the temperature of a cooking utensil on the grate 400 when the cooking utensil is heated by the corresponding gas burner 110. Temperature sensor 450 may be or include a resistance temperature detector, a thermocouple, an infrared temperature sensor, a bimetallic switch, etc. In exemplary embodiments, as mentioned, the temperature sensor 450 in each sensor finger 410 and 412 may be a thermistor and may have a second nominal resistance which is distinct from a first nominal resistance of the embedded thermal probes 310 and 312 in the griddle plate 300.

As may be seen, e.g., in FIG. 13, temperature sensor 450 may include a probe 452, a cap 454, a casing 456, a spacer 458 and a cover 460. Probe 452 may be coupled to a biasing member or spring, such that probe 452 is urged upwardly, e.g., towards a utensil positioned on the grate 400, by the spring. Probe 452 may be positioned within the casing 456 with a cap 454 over the probe 452. For example, the cap 454 may be placed above the probe 452 along the vertical direction V and/or between the probe 452 and a top surface of the grate 400 on which the cooking utensil may be placed, in order to prevent or minimize spilled material contaminating the temperature sensor 450, such as the probe 452 or other internal components thereof. The casing 456 may be mounted to sensor finger 410, e.g., at or within the first end 418 of the slot 414. Cover 460 may also be mounted to the sensor finger 410 within the slot 414 at the bottom 416 of sensor finger 410. Cover 460 may be positioned between the probe 452 and gas burner 110, e.g., along the vertical direction V. Additionally, the spacer 458 may be positioned between the probe 452 and cover 460, e.g., along the vertical direction V. Thus, cover 460 may advantageously shield probe 452 from direct heating by gas burner 110, and the spacer 458 may provide further insulation of the probe 452 from direct heating by the gas burner 110. For example, cover 460 and spacer 458 may block direct radiative heat transfer from flames at gas burner 110 to probe 452, and/or cover 460 and spacer 458 may shield probe 452 from direct convective heat transfer from air heated by gas burner 110.

A tubular sheath 462 is positioned within slot 414, and tubular sheath 462 may extend between probe 452 and a base 464 of the temperature sensor 450. Tubular sheath 462 may be a metal tubular sheath, such as an aluminum, copper, steel, or other suitable tube, such as a ceramic tube.

A wire 470 extends through tubular sheath 462 between probe 452 and the base 464. The base 464 may be or include a pogo pin terminal block, e.g., the base 464 of the first temperature sensor 450 embedded in the first grate 400 may be or provide a third pogo pin terminal block, and the base 464 of the second temperature sensor 450 embedded in the second grate 402 may be or provide a fourth pogo pin terminal block, where the third and fourth pogo pin terminal blocks may be connectable with the first pogo pin terminal block 150 and the second pogo pin terminal block 152. Wire 470 connects probe 452 and the pogo pin connectors on the base 464 to place probe 452 and base 464 in signal communication with each other. Thus, wire 470 may transmit electrical signals between probe 452 and base 464, such as a pogo pin terminal block and/or pogo pin connectors of the base 464. Wire 470 may include a woven fiberglass jacket or a woven steel mesh jacket. Such construction of wire 470 may advantageously limit conductive heat transfer between tubular sheath 462 and wire 470. Thus, wire 470 within tubular sheath 462 may be insulated for high temperatures.

The base 464 of the temperature sensor 450 may be positioned at or within the second end 420 of the slot 414. Thus, the temperature sensor 450 may extend within the slot 414 from the base 464 at the second end 420 of the slot 414 to the probe 452 at the first end 418 of the slot 414, whereby the temperature sensor 450 may be embedded within the grate 400, e.g., within the slot 414 of the grate 400. As mentioned, the base 464 may include a pogo pin terminal block having pogo pin connectors, e.g., contact pads or spring-loaded pins, for example, the base 464 may include two contact pads 466 for connecting with spring-loaded pins 154 of the first pogo pin terminal block 150 or the spring-loaded pins 156 of the second pogo pin terminal block 152 when the grate 400 is mounted on the frame 200 and the frame 200 is mounted on the panel 102. In alternative example embodiments, the relative position of spring loaded pins and contact pads on first and second pogo pin terminal blocks 150, 152 and the base 464 of the temperature sensor 450 may be reversed.

Such construction of the sensor finger 410 and temperature sensor 450 provides numerous advantages. For example, temperature sensor 450 is advantageously positioned proximate a cooking utensil on the grate 400 yet temperature sensor 450 and wire 470 are also shielded by sensor finger 410 and tubular sheath 462 from direct convective heating from gas burner 110. As another example, providing pogo pin terminal blocks, e.g., the base 464 of the or each temperature sensor 450, 452, having pogo pin connectors thereon, also allows grates 400 and 402 to be removed from the panel 102 without the need to manually disconnect any wiring. Such pogo pin connections may also accommodate variation in positioning of grates 400 and 402 on panel 102 while also maintaining good electrical signal. The foregoing advantages are described by way of example only and without limitation. Additional advantages of the present disclosure may also be apparent to those of ordinary skill in the art.

As mentioned above, the cooktop appliance 100 may include a controller 130, the griddle plate 300 may include first and second embedded temperature sensors, e.g., thermistors, 310 and 312, and the first and second grates 400 and 402 may include first and second sensor fingers 410 and 412, respectively, with each having a temperature sensor, e.g., thermistor, 450 embedded therein. The first and second embedded temperature sensors 310 and 312 of the griddle plate 300 may have a first nominal resistance and the temperature sensors 450 embedded in the sensor fingers 410 and 412 of the grates 400 and 402 may have a second nominal resistance different from the first nominal resistance. Each set of temperature sensors 310, 312 and 450 may be selectively in operative communication with the controller 130, e.g., may be in operative communication with the controller 130 via a connection between the first and second pogo pin terminal blocks 150 and 152 on the panel 102 and respective pogo pin connectors on each temperature sensor 310 and 312 or 450 when the griddle plate 300 or the grates 400 and 402 is or are mounted on the frame 200 while the frame 200 is mounted on the panel 102. In such embodiments, the controller 130 may be configured to recognize and distinguish between the two or more grates and the griddle plate based on the first nominal resistance and the second nominal resistance.

For example, the controller 130 may operable in a griddle mode and/or configured to operate in a griddle mode. The griddle mode may comprise coordinating operation of the first and second burners 110 and 112 to provide consistent or uniform heating across the griddle plate, as described in more detail below. In some embodiments, the controller 130 may be configured to automatically initiate or enter the griddle mode in response to detecting the first nominal resistance, e.g., of the first and second embedded temperature sensors 310 and 312 of the griddle plate 300, when the griddle plate 300 is mounted on the frame 200 and the frame 200 is mounted on the panel 102 such that the first and second embedded temperature sensors 310 and 312 are in communication with the controller 130 via the pogo pin connections described above.

In an exemplary embodiment of the griddle mode, the heat output of each burner 110 and 112 may be determined based on a set temperature and a measured temperature. The controller 130 may receive a combined command, such as a single set temperature, e.g., for use with the griddle plate 300, for the first gas burner 110 and the second gas burner 112. The combined command may generally direct a desired heat output for both the first burner 110 and the second burner 112 to achieve the same set temperature across the griddle plate 300. For example, the set temperature may be entered at the user interface panel. In at least some embodiments, the heat output of the first burner 110 may be determined based on the set temperature and a first measured temperature measured by the first embedded temperature sensor 310, while the heat output of the second burner 112 may be determined based on the set temperature and a second measured temperature measured by the second embedded temperature sensor 312. The set temperature and the or each measured temperature may be input into a closed-loop control algorithm, such as a proportional-integral-derivative (PID) control loop. The closed-loop control algorithm may output a desired heat output at each of the burners 110 and 112 and/or a flow rate, e.g., the volumetric flow rate in cubic meters per second, of fuel to the first burner 110 and the second burner 112. In various embodiments, the burners 110 and 112 may be controlled simultaneously or independently to provide a uniform temperature across the griddle plate 300, e.g., to meet or approximate the single set temperature at multiple locations on the top cooking surface 302 of the griddle plate 300, despite variations such as varying sizes of the burners 110 and 112, varying cook loads at different location on the top cooking surface 302, etc.

The cooktop appliance 100 shown in FIGS. 1 through 13 illustrates various example embodiments of the present disclosure. Thus, although described in the context of cooktop appliance 100, the present disclosure may be used in cooktop appliances having other configurations, e.g., a cooktop appliance with fewer burner assemblies or additional burner assemblies. Similarly, the present disclosure may be used in cooktop appliances that include an oven, i.e., range appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a panel comprising a top surface and a bottom surface;

a first burner disposed on the panel;

a second burner spaced apart from the first burner on the panel;

a first pogo pin terminal block positioned on the panel adjacent to the first burner;

a second pogo pin terminal block positioned on the panel adjacent to the second burner; and a frame removably mounted to the top surface of the panel;

wherein the frame is configured to selectively support two or more grates over the first burner and the second burner or a griddle plate over the first burner and the second burner.

2. The cooktop appliance of claim 1, wherein the frame comprises a first sleeve which encloses first connectors of the first pogo pin terminal block on four sides when the frame is mounted to the top surface of the panel and a second sleeve which encloses second connectors of the second pogo pin terminal block on four sides when the frame is mounted to the top surface of the panel.

3. The cooktop appliance of claim 1, wherein the first connectors and the second connectors are positioned above the first burner and the second burner.

4. The cooktop appliance of claim 1, wherein the cooktop appliance defines a lateral direction, a transverse direction orthogonal to the lateral direction, and a vertical direction orthogonal to the lateral direction and the transverse direction, wherein the first burner and the second burner are spaced apart along the lateral direction, the first pogo pin terminal block positioned opposite the second burner along the lateral direction, and the second pogo pin terminal block positioned opposite the first burner along the lateral direction.

5. The cooktop appliance of claim 4, wherein the frame comprises a first leg and a second leg positioned opposite the first leg along the transverse direction, wherein the frame further comprises a third leg and a fourth leg positioned opposite the third leg along the transverse direction.

6. The cooktop appliance of claim 5, wherein the frame comprises a first sleeve which encloses first connectors of the first pogo pin terminal block on four sides when the frame is mounted to the top surface of the panel and a second sleeve which encloses second connectors of the second pogo pin terminal block on four sides when the frame is mounted to the top surface of the panel, the first leg and the second leg aligned with the first sleeve along the transverse direction with the first sleeve positioned between the first leg and the second leg, the third leg and the fourth leg aligned with the second sleeve along the transverse direction with the second sleeve positioned between the third leg and the fourth leg.

7. The cooktop appliance of claim 5, wherein the first leg and the second leg are disposed on the frame opposite the third leg and fourth leg along the lateral direction, and wherein the frame spans unsupported across the first burner and the second burner with the first burner and the second burner between the first leg and the third leg along the lateral direction when the frame is mounted to the top surface of the panel.

8. The cooktop appliance of claim 4, wherein the first burner and the second burner are aligned with each other and with the first pogo pin terminal block and the second pogo pin terminal block along the transverse direction.

9. The cooktop appliance of claim 1, wherein the frame comprises a peripheral support surface extending completely around a perimeter of the frame, the peripheral support surface configured to selectively support a first grate on a first half of the peripheral support surface and a second grate on a second half of the peripheral support surface or a griddle plate on the entire peripheral support surface.

10. The cooktop appliance of claim 9, wherein the peripheral support surface of the frame comprises a front portion, a left side portion extending perpendicular to the front portion from a left end of the front portion at a front end of the left side portion, a back portion parallel to the front portion extending from a back end of the left side portion at a left end of the back portion, and a right side portion extending parallel to the left side portion from a back end of the right side portion at a right end of the back portion to a front end of the right side portion at a right end of the front portion, and a crossbar extending from a midpoint of the front portion to a midpoint of the back portion, wherein the peripheral support surface is defined along the front portion, the left side portion, the back portion, and the right side portion, and wherein the crossbar defines an intermediate support surface, wherein the intermediate support surface is configured to selectively support the first grate at a first side of the intermediate support surface and the second grate at a second side of the intermediate support surface or to support a middle section of the griddle plate.

11. The cooktop appliance of claim 1, further comprising a controller, wherein each grate of the two or more grates includes an embedded temperature sensor and the griddle plate includes an embedded griddle temperature sensor, the controller in operative communication with the embedded temperature sensors in the two or more grates when the frame is mounted to the top surface of the panel and the two or more grates are supported on the frame and in operative communication with the embedded griddle temperature sensor when the frame is mounted to the top surface of the panel and the griddle plate is supported on the frame, wherein the embedded temperature sensors in the two or more grates have a first nominal resistance and the embedded griddle temperature sensor has a second nominal resistance different from the first nominal resistance, and wherein the controller is configured to recognize and distinguish between the two or more grates and the griddle plate based on the first nominal resistance and the second nominal resistance.

12. A cooktop appliance comprising:

a panel comprising a top surface and a bottom surface;

a first burner disposed on the panel;

a second burner spaced apart from the first burner on the panel;

a first pogo pin terminal block positioned on the panel adjacent to the first burner;

a second pogo pin terminal block positioned on the panel adjacent to the second burner;

a frame removably mounted to the top surface of the panel, the frame spanning the first burner and the second burner; and a griddle plate positioned on the frame above the first burner and the second burner, the griddle plate comprising a first embedded temperature sensor above the first burner and a second embedded temperature sensor above the second burner.

13. The cooktop appliance of claim 12, wherein the griddle plate extends from a bottom surface in contact with the frame and facing the first burner and the second burner to a top surface opposite the bottom surface, the top surface configured for receiving food items thereon, wherein the first embedded sensor and the second embedded sensor are positioned between the bottom surface and the top surface.

14. The cooktop appliance of claim 12, wherein the first embedded temperature sensor is positioned directly over the first burner and the second embedded temperature sensor is positioned directly over the second burner.

15. The cooktop appliance of claim 12, wherein the first embedded temperature sensor is concentric with the first burner and the second embedded temperature sensor is concentric with the second burner.

16. A cooktop appliance comprising:

a panel comprising a top surface and a bottom surface;

a first burner disposed on the panel;

a second burner spaced apart from the first burner on the panel;

a first pogo pin terminal block positioned on the panel adjacent to the first burner;

a second pogo pin terminal block positioned on the panel adjacent to the second burner;

a frame removably mounted to the top surface of the panel, the frame spanning the first burner and the second burner;

a first grate positioned on the frame above the first burner and a second grate positioned on the frame above the second burner, the first grate comprising a first plurality of fingers, the first plurality of fingers comprising a first sensor finger with a first temperature sensor embedded in the first sensor finger above the first burner and the second grate comprising a second plurality of fingers, the second plurality of fingers comprising a second sensor finger with a second temperature sensor embedded in the second sensor finger above the second burner.

17. The cooktop appliance of claim 16, wherein the first sensor finger comprises an open slot facing the first burner, the first temperature sensor embedded in the open slot of the first sensor finger, and the second sensor finger comprises an open slot facing the second burner, the second temperature sensor embedded in the open slot of the second sensor finger.

18. The cooktop appliance of claim 16, wherein the first temperature sensor is positioned directly over the first burner and the second temperature sensor is positioned directly over the second burner.

19. The cooktop appliance of claim 16, wherein the first temperature sensor is concentric with the first burner and the second temperature sensor is concentric with the second burner.

* * * * *